US008752813B2

(12) United States Patent
Meyer

(10) Patent No.: US 8,752,813 B2
(45) Date of Patent: Jun. 17, 2014

(54) FLETCHING DEVICE

(76) Inventor: Paul-René Meyer, Halle/Westfalen (DE)

( * ) Notice: Subject to any disclaimer, the term of this patent is extended or adjusted under 35 U.S.C. 154(b) by 146 days.

(21) Appl. No.: 13/500,111

(22) PCT Filed: Nov. 9, 2010

(86) PCT No.: PCT/DE2010/001308
§ 371 (c)(1),
(2), (4) Date: Apr. 4, 2012

(87) PCT Pub. No.: WO2011/057610
PCT Pub. Date: May 19, 2011

(65) Prior Publication Data

US 2012/0200022 A1 Aug. 9, 2012

(30) Foreign Application Priority Data

Nov. 12, 2009 (DE) ..... 20 2009 015 311 U

(51) Int. Cl.

| | |
|---|---|
| ***B25B 1/20*** | (2006.01) |
| ***A63B 67/14*** | (2006.01) |
| ***F41B 5/00*** | (2006.01) |
| *B25B 11/00* | (2006.01) |

(52) U.S. Cl.
USPC ..... 269/38; 473/586; 124/86

(58) Field of Classification Search
USPC ..... 269/38; 473/586; 124/86, 79
See application file for complete search history.

(56) References Cited

U.S. PATENT DOCUMENTS

| | | | | | |
|---|---|---|---|---|---|
| 1,648,376 | A | * | 11/1927 | Blodgett | 269/38 |
| 1,945,416 | A | * | 1/1934 | Birchall | 269/38 |
| 2,918,097 | A | | 12/1959 | Thompson | |
| 3,027,156 | A | | 3/1962 | Schnoor | |
| 3,338,772 | A | | 8/1967 | Mcwherter | |
| 4,366,022 | A | * | 12/1982 | Coffman | 156/538 |
| 4,653,738 | A | * | 3/1987 | York | 269/38 |
| 4,867,426 | A | * | 9/1989 | Mellick | 269/38 |
| 5,211,382 | A | * | 5/1993 | Finlay | 269/38 |
| 5,987,724 | A | * | 11/1999 | Kleman | 29/401.1 |
| 6,666,204 | B1 | * | 12/2003 | Hedrick | 124/86 |
| 7,074,143 | B2 | * | 7/2006 | Czemske et al. | 473/586 |
| 7,892,119 | B2 | * | 2/2011 | Marshall | 473/586 |
| 8,333,369 | B2 | * | 12/2012 | Kozlik et al. | 269/9 |
| 2005/0178375 | A1 | * | 8/2005 | Sutherland et al. | 124/79 |

FOREIGN PATENT DOCUMENTS

| | | |
|---|---|---|
| DE | 89 08 368 | 9/1989 |

* cited by examiner

*Primary Examiner* — Lee D Wilson
*Assistant Examiner* — Alvin Grant
(74) *Attorney, Agent, or Firm* — Michael J. Striker

(57) ABSTRACT

The present invention relates to a fletching device for adhesively bonding arrow feathers onto arrow shafts and quarrels, comprising a base plate (9) having a support for the nock of an arrow, retaining rods (8) extending upward therefrom at a distance from each other, an upper cover plate (12) having a passage opening directing upward and a centering means for the shaft of an arrow (1), and retaining clamps (3) arranged on the retaining rods (8) for the arrow feathers to be adhesively bonded. The fletching device is characterized in that the centering means for the arrow shaft is similar to the chuck (7) of a drilling machine or comprises an adapted chuck (7) of a drilling machine.

11 Claims, 2 Drawing Sheets

FLETCHING DEVICE

Figure 1:
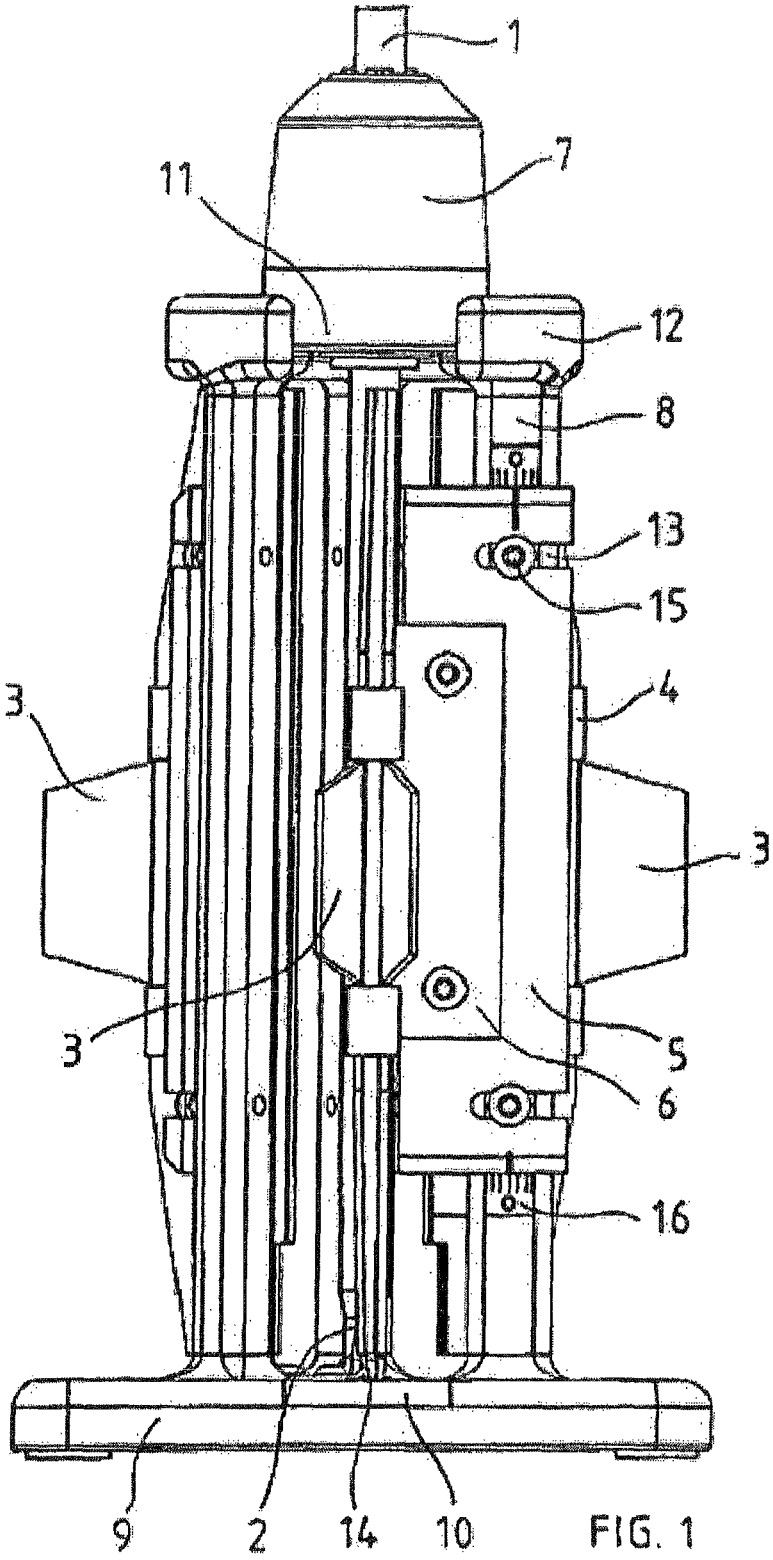

The invention relates to a fletching device for adhesively bonding arrow feathers onto arrow shafts or quarrels, comprising a base plate having a support for the nock of an arrow, retaining rods extending upward from the base plate at a distance from each other, and an upper cover plate having an upwardly directed passage opening and a centering means for the shaft of an arrow, and retaining clamps disposed on the retaining rods for the arrow feathers to be adhesively bonded.

A plurality of embodiments of such fletching devices exists, which are used to position feathers, individually or in plurality simultaneously, on the shafts of arrows and retain them thereon while an adhesive hardens, as described in U.S. Pat. No. 2,918,097, for example.

The main disadvantage of the known types of fletching of arrows is that the adhesives that are typically used must dry for a very long time since, when other adhesives are used, it often happens that the "natural feathers" used during the indoor season in particular, which are a natural product from turkey farming, return to their naturally curved shape. Other known fletching devices, which can also be used to adhesively bond three feathers simultaneously, are made partially of plastic, which partially dissolves or at least softens upon contact with the aforementioned adhesive. Furthermore, such fletching devices require the purchase of additional adapters to enable adaptation to different arrow thicknesses and to fletch arrows having different thicknesses. A further disadvantage is that, in many models of known fletching devices, the nocks of the arrows, which is to say, the V-shaped retaining devices at the end of the arrows for fastening an arrow on a cord, must first be removed from an arrow in order to place it on a mandrel in a fletching device.

In a few known fletching devices, slots for the feathers are provided in the retaining devices, which are produced by plastic injection-molding, and therefore the swirl with which the feathers can be adhered onto the shaft is always fixedly specified and, to change the swirl, other retaining arms must be inserted into the fletching device, which, however, are separate bought-in parts and represent an unnecessary cost factor.

Moreover, in many devices, such retaining arms are provided only for feathers up to a maximum of 4.45 cm (1.75 inches) or 10.16 cm (4.00 inches) in length, and cannot be changed, and therefore feathers that are 12.70 cm (5 inches) long and are likewise very common in the market cannot be installed using these known fletching devices. Other fletching devices can only be used for arrows having an outer diameter of maximum 7.3 mm, thereby entirely ruling out the use of the devices for indoor arrows, which have a preferred outer diameter of 9.3 mm, for example. Such fletching devices therefore make it necessary to purchase a complete second fletching device in order to process all known arrow thicknesses.

A further disadvantage of the known fletching devices is that re-attaching individual feathers is often very painstaking since the intact feathers that are still present on the shaft must always first be fitted into the retaining arms, which must always be used with the majority of fletching devices on the market because the devices are one fixed unit. Due to the different nock positions associated with recurve bow arrows and compound bow arrows, it is also very difficult and complicated to fletch new arrows when arrows of the other type are already present.

The problem addressed by the invention is that of providing a fletching device with which a plurality of feathers can be adhesively bonded simultaneously and which comprises a retaining device for the feathers that is independent of the feather length and the feather thickness, can be used for all shapes of arrows and quarrels without replacing the individual components, and with which the twirls of feathers can also be adjusted freely and in a reproducible manner and, moreover, that the fletching device overall is resistant to all commercially available adhesives. Moreover, the innovative fletching device also makes it possible to re-attach individual feathers quickly and easily without time-consuming adaptation work, and it should be possible to implement the different nock position of curve bow arrows and compound bow arrows without acting manually on the end of an arrow. A basic condition therefor is the solution of the problem, however, that it should be possible to insert an arrow end or a quarrel into such a fletching device easily and centered in an optimal manner, thereby automatically ensuring that the feathers can be attached to the arrow shaft completely symmetrically when it is inserted into the fletching device.

This problem is solved, in conjunction with the features of the preamble in combination with the technical features of the characterizing part of the first claim, in particular in that the centering means for the arrow shaft is similar to a chuck of a drilling machine or comprises an adapted chuck of a drilling machine.

This centering means according to the invention is disposed in the upper region of the fletching device at the upper cover plate such that it is removable therefrom, and therefore the chuck can first be slid from the tip of an arrow onto the arrow, which can then be inserted by way of the lower end thereof onto the support for the nock into the fletching device, wherein tightening the chuck causes the jaws thereof to automatically center and tightly clamp the arrow shaft in the fletching device.

Further advantageous embodiments of the subject matter of the invention will become apparent from the dependent claims that follow, and from combinations thereof.

According to a particularly preferred embodiment of the subject matter of the invention, the chuck is in the form of a quick-clamping chuck, thereby permitting it to be operated manually without the use of a chuck key, thereby further simplifying the handling of the fletching device.

Furthermore advantageous is the embodiment of the cover plate for receiving the chuck in the form that the chuck is supported centered in the cover plate in alignment by way of the support for the nock on the base plate of the fletching device, which can be achieved, for example, by way of appropriate axial milling of the cover plate or by way of metal bolts that are radially disposed and protrude from the cover plate, which can be arranged radially around the chuck and can protrude axially from the cover plate.

To permit convenient insertion of the arrow, which is equipped with the chuck, the cover plate is provided with a radial recess, thereby enabling the arrow to be inserted laterally into the fletching device and removed therefrom and, if the intention is to only re-attach individual feathers, the other two feathers, which are still intact, do not require any more attention, for instance, they do not need to be inserted into slots provided in a fletching device according to the prior art.

A further advantageous embodiment of the fletching device according to the invention is disposed on a nock cone such that it can rotate through an angle, and therefore the fletching device can be adapted for arrows for the compound bow range or for the recurve bow range by simply adjusting the nock cone, or, for repair work or to re-attach individual feathers to damaged arrows, the device can be adjusted in such a way that the repair site can be accessed in an optimal manner. To this end, the nock cone can be advantageously rotated by 90°, wherein markings "C" for "Compound" and "R" for "Recurve" are provided on the base plate, to simplify and display the correct setting of the fletching device.

The fletching device is preferably equipped with three retaining rods, which are disposed on a circle at 120° intervals, wherein a vertically longitudinally extending retaining plate is mounted on each retaining rod in an angularly displaceable manner via two slots by way of two retaining screws, and a retaining magnet for fixing a retaining clamp of an arrow feather is fastened on the retaining plate. This design makes it possible to insert arrow feathers outside of the device into the retaining clamps, which also have a length that is greater than the longest known arrow feathers, wherein the retaining clamps that are subsequently attached to the retaining magnets can be placed radially onto the shaft of an arrow, wherein, by way of the slots, the retaining plates ensure that the feathers are disposed on the shaft at exactly right angles or permit a twist to be specified in such a way that it can be adjusted in an exactly reproducible manner on all feathers by arranging all retaining plates identically, at a slight angle at the longitudinal axis of an arrow, which is made possible by way of appropriate scale markings.

It is furthermore advantageous that the chuck can be steplessly adapted to all known outer diameters of outdoor and indoor arrows, thereby permitting a single fletching device to be used for all known types of arrows and quarrels without the need to replace components or subsequently purchase additional components.

In summary, the advantages of the present invention are therefore that all feathers can be adhesively bonded to the shaft of an arrow simultaneously, which can be accomplished using only one holder compared to known fletching devices, thereby resulting in significant time savings. Moreover, all arrow thicknesses and all feather lengths can be used with only one device without replacing components, and the twist with which the feathers are adhesively bonded can be arbitrarily varied. The fletching device according to the invention makes it possible to use all known adhesives, of course, and makes it possible to re-fletch an arrow having only one defective feather without the need to make complex adaptations to the fletching device.

An exemplary embodiment of the invention is described in greater detail in the following with reference to drawings.

Shown are:

FIG. 1 a side view of a fletching device with an arrow inserted, and

Figure 2:
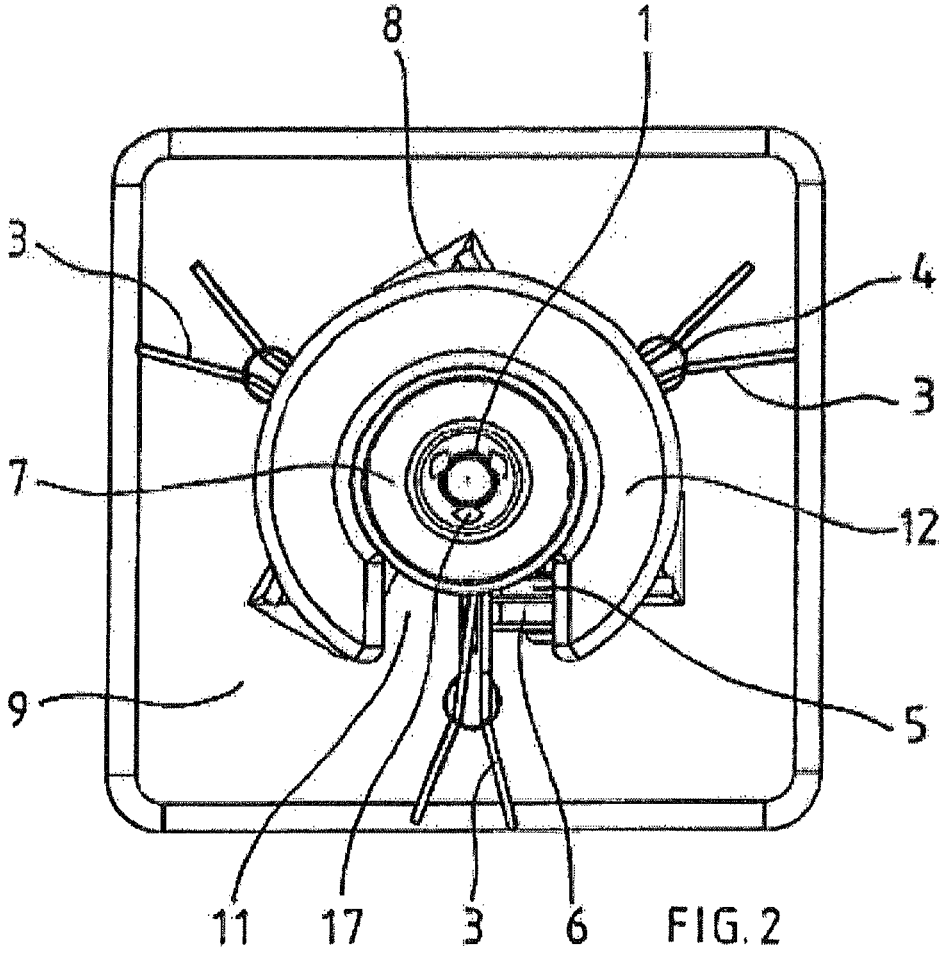

FIG. 2 a top view of the fletching device according to 1.

The fletching device for adhesively bonding arrow feathers onto shafts of arrows 1 or quarrels mainly comprises a base plate 9 having a support, which is in the form of a dovetail 14, for the arrow nock 2 of an arrow 1, retaining rods 8 extending upward from the base plate 9 at a distance of 120° from each other and around a midpoint circle about the dovetail 14, said cover plate having an upwardly directed passage opening and a centering means, which is in the form of a quick-clamping chuck 7, for the shaft of an arrow 1. Retaining clamps 3 for the arrow feathers to be adhesively attached are disposed on the retaining rods 8, wherein the retaining clamps 3 are each made of two sheet metal pieces, which are held clamped against one another by springs 4 and have a length that is greater than all commercially available feathers for placement on arrows 1 or quarrels, such as 175 mm.

These retaining clamps 3, which are made of metal, are held by magnets 6, which are disposed on retaining plates 5 that, in turn, are fastened to the retaining arms 8, wherein the retaining plates 5 are equipped with slots 13 through which the retaining screws 15 extend, by way of which the retaining plates 5 can be adjusted with the aid of scale markings 16 on the retaining arm 8 in such a way that the feathers to be arranged on a shaft of an arrow 1 can be bonded thereto in a straight line or with a twist.

The quick-clamping chuck 7 is centered by way of an axial recess in the cover plate 12, wherein such a centering means can also be formed by bolts protruding from the cover plate 12 or other centering aids.

The cover plate 12 is equipped with a radial recess 11 for the easy insertion and removal of an arrow 1, thereby permitting a arrow 1 to be inserted laterally into the fletching device even if only a single feather is defective; the retaining clamps 3 that are not required can be temporarily removed from the fletching device for this purpose.

The nock cone 10, which carries the dovetail 14, is supported in the base plate 9 such that it can rotate by at least 90°, wherein the corresponding angular positions for recurve arrows or compound arrows are marked on the nock cone 10 and the base plate 9.

The centering means of the shaft of an arrow 1, which is in the form of a quick-clamping chuck 7, can be adapted to any arrow diameter without tools and steplessly, wherein the jaws 17 of the chuck 7 automatically center and clamp it.

Before an arrow is inserted into the fletching device, the chuck 7 is slid over the arrow tip of the arrow 1, the arrow 1 is placed by way of the arrow nock 2 thereof onto the dovetail 14 on the nock cone 10, the chuck 7 is adjusted and tightened, whereupon the chuck can also be clamped in the upper cover plate 12 to ensure that the arrow 1 has a secure seat in the fletching device.

The invention claimed is:

1. A fletching device for adhesively bonding arrow feathers onto arrow shafts and quarrels, comprising a base plate (9) having a support for the nock of an arrow, retaining rods (8) extending upward from the base plate (9) at a distance from each other, and an upper cover plate (12) having an upwardly directed passage opening and a centering means for the shaft of an arrow (1), and retaining clamps (3) disposed on the retaining rods (8) for the arrow feathers to be adhesively bonded, characterized in that the centering means for the arrow shaft comprises a chuck (7) including chuck jaws (17) defining an axial recess in the passage, wherein the clutch jaws (17) clamp to center and hold an upper part of the arrow shaft and, unclamp to release the upper part of the arrow shaft.

2. The fletching device according to claim 1, characterized in that the chuck (7) is in the form of a quick-clamping chuck.

3. The fletching device according to claim 1, characterized in that the cover plate (12) comprises a receptacle for the chuck (7), in which the chuck is retained, centered and at a distance over the support for the nock.

4. The fletching device according to claim 1, characterized in that a radial recess (11) is provided in the cover plate (12) for the lateral insertion and removal of an arrow (1).

5. The fletching device according to claim 1, characterized in that a dovetail (14) is disposed in the base plate (9), as a support for the nock (2) of an arrow (1), on a nock cone (10) that is rotatable through an angle.

6. The fletching device according to claim 1, characterized in that a retaining plate (5) is mounted in an angularly displaceable manner at each retaining rod (8) via two slots (13) by way of two retaining screws (15), on which a retaining magnet (6) for fixing a retaining clamp (3) of an arrow feather is mounted.

7. The fletching device according to claim 1, characterized in that each retaining clamp (3) has an effective clamping length that is greater than the longest known arrow feather.

8. The fletching device according to claim 1, characterized in that the chuck (7) has an inner diameter of up to 15 mm, which can be steplessly adapted to the arrows (1).

9. The fletching device according to claim 1, characterized in that three retaining rods (8) are provided, which are offset by 120° with respect to one another on a circular arc.

10. The fletching device according to claim 1, characterized in that the nock cone (10) is rotatably supported in the base plate (9), and an angular position for recurve arrows and an angular position for compound arrows are provided and are marked on the base plate (9).

11. The fletching device according to claim 1, wherein the centering means (7) is arranged in the cover plate (12) at the upper most part of the fletching device.

* * * * *